US005117971A

United States Patent [19]

Fisher

[11] Patent Number: 5,117,971

[45] Date of Patent: Jun. 2, 1992

[54] JEWELRY DISPLAY BOX

[76] Inventor: Mildred K. Fisher, Box 2026 C.S.R., Winkelman, Ariz. 85292

[21] Appl. No.: 701,757

[22] Filed: May 17, 1991

[51] Int. Cl.[5] ..... B65D 5/48; B65D 1/24

[52] U.S. Cl. ..... 206/6.1; 206/45.11; 206/45.15; 206/45.34; 206/486; 206/566; 220/533

[58] Field of Search ..... 206/6.1, 45.11, 45.15, 206/486, 495, 566, 45.34; 220/532, 533

[56] References Cited

U.S. PATENT DOCUMENTS 4,396,121 8/1983 Lemmon ..... 206/566
4,420,084 12/1983 Whelan ..... 206/566
4,746,009 5/1988 Liberman ..... 206/45.15 X
4,811,996 3/1989 Hensson ..... 206/566 X
4,848,585 7/1989 Snyder ..... 206/495 X

*Primary Examiner*—Bryon P. Gehman
*Attorney, Agent, or Firm*—Harry M. Weiss

[57] ABSTRACT

A jewelry display box which incorporates a completely transparent structure, a removable top, and a plurality of sliding mouting plates each preferably with cut-out portions to serve to visibly, effectively, and efficiently store and inspect a varied collection of jewelry including wide jewelry items such as hoop earrings using the cut-out portions of each mounting plate to enable attaching the hoop earrings to each of the mounting plates.

4 Claims, 1 Drawing Sheet

JEWELRY DISPLAY BOX

BACKGROUND OF THE INVENTION

1. Field of the Invention

The invention generally relates to boxes for storing and displaying jewelry, and, more specifically, to an improved jewelry display box that can retain large amounts of jewelry that have different sizes and configurations in an easily accessible and visible manner.

2. Description of the Related Art

In the past, I developed and patented a jewelry display box (see my U.S. Pat. No. 4,396,121 under my former married name) which provided a way of both mounting and displaying jewelry such as earrings, etc. This earlier U.S. patent of mine was a significant improvement over other products previously disclosed for storing or displaying jewelry. In one type of prior art product prior to my U.S. Patent, a jewelry box was fabricated in a configuration resembling a miniature piece of furniture, such as a china closet, chest, dresser, etc. While this type of jewelry box was aesthetically pleasing, the small storage containers within it were insufficient to separately store an individual's large quantity of jewelry. The result was often a tangled conglomeration of chains and earrings. In addition, there was not included a way to visibly display the jewelry.

In another type of prior art product prior to my U.S. Patent, jewelry display frames took the shape of many popular items, such as television characters, animals, mushrooms, trees, etc. According to this prior art disclosure, the jewelry was attached to hooks on or inserted through holes in the figures. While the jewelry was visibly displayed, only small quantities of jewelry could be attached to the limited peripheral area of any figure. In addition, these figures were relatively unstable and did not protect the jewelry because the figures would easily tip over, often causing damage to many pieces of jewelry.

My prior issued U.S. Patent disclosed an easy to use jewelry display box that could display earrings, chains and pins, but could not display wider jewelry objects such as large hoop type earrings and other wide shaped jewelry pieces.

Therefore, the need existed to provide an improved jewelry display box capable of combining the abilities to effectively store, display, protect, and provide easy access to a large amount of jewelry of different sizes and configurations including large hoop type earrings and other wide shaped jewelry pieces.

SUMMARY OF THE INVENTION

According to one embodiment of this invention, it is an object of this invention to provide an improved jewelry display box that can also contain and display wide type jewelry items such as hoop type earrings, etc.

It is another object of this invention to provide an improvement jewelry display box capable of individually storing large quantities of jewelry, such as earrings, chains, and pins and including wide type jewelry items such as hoop type earrings, etc.

It is yet another object of this invention to provide an improved jewelry display box that is transparent so as to allow for all the jewelry stored in the box to be visible including wide type jewelry items such as hoop type earrings, etc.

BRIEF DESCRIPTION OF THE PREFERRED EMBODIMENT

Briefly described, and in accordance with one embodiment of this invention, an improved transparent jewelry display box is disclosed comprising a plurality of transparent mounting boards for storing jewelry to be displayed and mounted so as to slide vertically within internal tracks which are disposed to receive each one of the mounting board's full length. Jewelry is retained or attached to holes located in each of the mounting boards through which earrings, tie tacks or chains can be inserted thereto. At least one of the mounting boards and preferably two or more of the mounting boards contain a cut-out portion to permit wide jewelry pieces such as hoop type earrings to be attached to the mounting board(s) containing the cut-out portion(s) to thereby permit the wide jewelry pieces to be contained within the enlarged space(s) created by the cut-out portion(s). The jewelry display box, containing the plurality of sliding mounting boards at least one or more with a cut-out portion, is then preferably covered with a transparent top which fits on the top of the box. In the enclosed depicted configuration, each of the sliding mounting boards are held in place within the box and the jewelry including wide jewelry pieces is thereby both displayed and protected.

The foregoing and other objects, features and advantages will be apparent from the following description of the preferred embodiments of the invention as illustrated in the accompanying drawings.

DESCRIPTION OF THE PREFERRED EMBODIMENT

Figure 1:
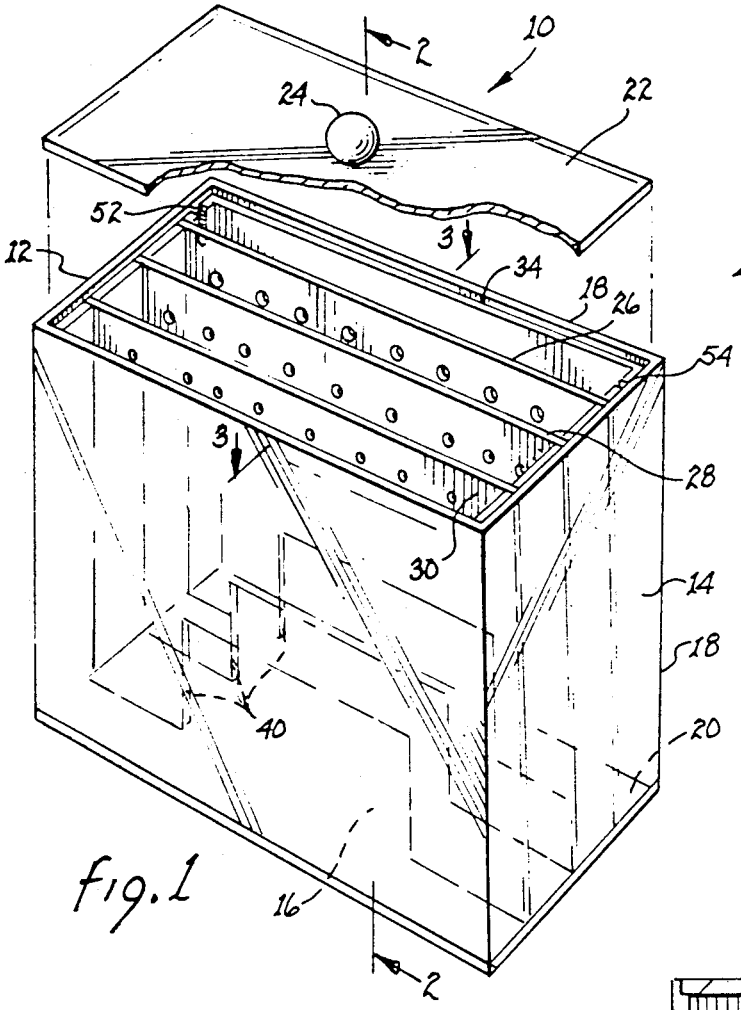
FIG. 1 is a perspective view of the jewelry display box of this invention with the top lifted off disclosing a plurality of mounting boards located therein.

Referring to FIG. 1, the jewelry display box of this invention is referenced generally by the number 10 The frame of the box is comprised of vertical side wall panels 12 and 14, vertical front and back panels 16 and 18 respectively, bottom floor panel 20, and sliding top cover 22. Connected to the top cover 22 to serve as a means to grasp by a person's hand is a knob 24, or some other suitable means of firmly holding the removable top cover 22. Also configured in a removable manner are, for example, three mounting plates 26, 28 and 30 slidably mounted in tracks 32 (see FIG. 3) within an inner frame structure 34 (see FIGS. 1 and 3).

Figure 2:
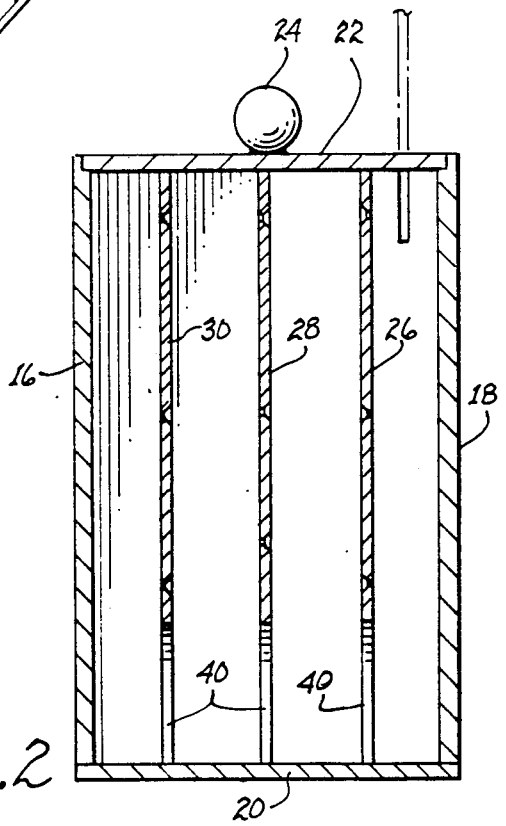
FIG. 2 is a cut-away view of the jewelry display box of FIG. 1 taken along the line 2—2 of FIG. 1.

Referring to FIG. 2 and to FIG. 1, the top plate or cover 22 is fabricated so as preferably be press fit onto the top of the inner frame 34 in the space provided because the inner frame 34 is slightly lower than the side, front and back panels, respectively, 12, 14, 16 and 18. In this manner, the top panel or cover 22 can be easily lifted off of the top of jewelry display box 10, allowing access to or removal of one or more of the mounting plates 26, 28 and 30.

Figure 3:
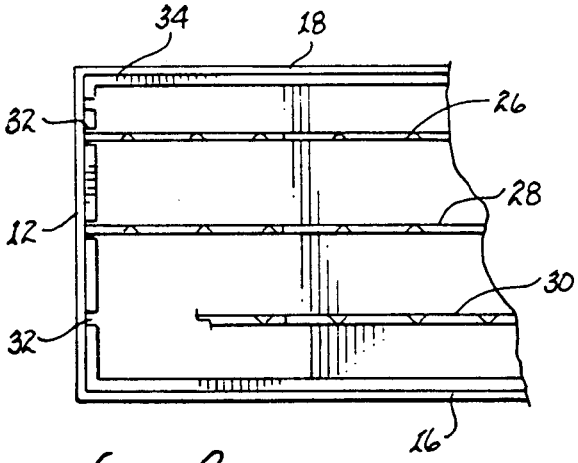
FIG. 3 is a cut-away view of the jewelry display box of FIG. 1 taken along the line 3—3 of FIG. 1.

Referring to FIG. 3, the removable mounting plate 26 slides into its two rails 32 (only one of which is shown in FIG. 3). The rail 32 for the mounting plate 30 is shown empty for illustrating the way the mounting plate 30 is removed from the box 10.

Figure 4:
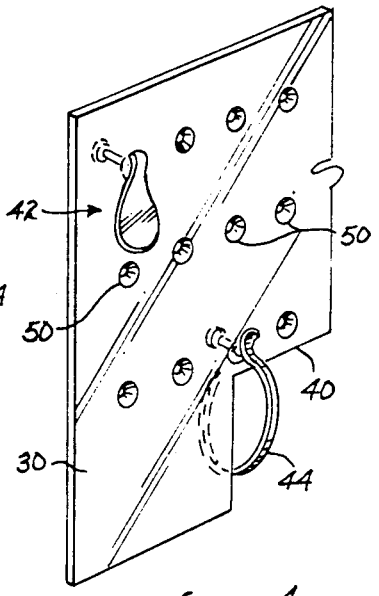
FIG. 4 is a cut-away view of one of the mounting boards (having a cut-out portion) used in the jewelry display box of FIG. 1.

Referring to FIGS. 1, 2 and 4, the mounting plates 26, 28 and 30 are shown with preferably each having a cut-out portion 40. The cut-out portion 40 in the mounting plates 26, 28 and 30 provide enlarged spaces in the bottom of the jewelry box 10 to mount wide type jewelry items such as hoop earrings etc. In FIG. 4, the mounting plate 30 illustrates how, for example, a small piece type earring 42 can be attached to the mounting plate 30 while a hoop type earring 40 is also attached to the mounting plate 30 using the cut-out portion 40 and the enlarged space provided by the cut-out portion 44 and the adjacent plate 28 and front panel 16. With reference to FIG. 4, countersunk holes 50 provide a more secure method of attaching the various pieces of jewelry to the mounting plate 30 because of the enlarged opening thereby permitting a more secure (recessed) grip for the jewelry pieces, if needed.

OPERATION

To load or store earrings, for example, the top or cover 22 is first removed, then each mounting plate is slid out of the jewelry box 10 and preferably inserted into short notches 52 and 54, whereby each mounting plate is securely held by the frame 34 of the box 10 above the box 10. As a result, both hands of the user are free to store or remove the stored jewelry item. For example, one or more earrings are then inserted through one or more of the holes 50 and clasped on the other side. Each mounting plate is returned to its position back inside the display box 10 and the top or cover 22 is placed back into place. In this manner, one can easily, visibly, and effectively store jewelry of all sizes and shapes including wide jewelry items such as hoop earrings.

Whereas the invention has been particularly shown and described with reference to preferred embodiments thereof, it will be understood by those skilled in the art that the foregoing and other changes in form and details may be made therein without departing from the spirit and scope of the invention.

What is claimed is:

1. A jewelry display case comprising:

a plurality of removable mounting jewelry display board means for holding and displaying jewelry items to be displayed, each of said display board means being made of transparent material and having a plurality of apertures for holding said jewelry items;

each of said plurality of removable mounting jewelry display board means having cut-out portion means for enabling wide jewelry items to be attached to said display board means using an enlarged space provided by said cut-out portion means and adjacent display board means; and a box member having at least a plurality of internal tracks with each one of said plurality of tracks being disposed to receive the full length of one of said display board means, said box member being made of transparent material.

2. The jewelry display case of claim 1 wherein at least one of said display board means having said cut-out portion means located at a bottom portion of said display board means.

3. The jewelry display case of claim 2 wherein each of said display board means having said cut-out portion means located at a bottom portion of said display board means.

4. The jewelry display case of claim 1 wherein each of said display board means having countersunk holes located in one surface portion of each of said display board means.

* * * * *